US006575096B1

(12) United States Patent
Caruthers et al.

(10) Patent No.: US 6,575,096 B1
(45) Date of Patent: Jun. 10, 2003

(54) COMPUTER CONTROLLED MIXING OF CUSTOMER-SELECTED COLOR INKS FOR PRINTING MACHINES

(75) Inventors: Edward Blair Caruthers, Rochester, NY (US); R. Enrique Viturro, Rochester, NY (US); Nancy Beth Goodman, Webster, NY (US); George A. Gibson, Fairport, NY (US); James R. Larson, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/986,101

(22) Filed: Nov. 7, 2001

(51) Int. Cl.[7] ..... B41F 31/00

(52) U.S. Cl. ..... 101/491; 101/483; 101/484; 399/54

(58) Field of Search ..... 101/491, 483, 101/484; 399/54

(56) References Cited

U.S. PATENT DOCUMENTS

| | | | |
|---|---|---|---|
| 3,357,402 | A | 12/1967 | Bhagat |
| 4,733,273 | A | 3/1988 | Lloyd |
| 4,883,018 | A | 11/1989 | Sagiv |
| 5,270,702 | A | 12/1993 | Krolak |
| 5,355,201 | A | 10/1994 | Hwang |
| 5,713,062 | A | 1/1998 | Goodman et al. |
| 5,897,239 | A | 4/1999 | Caruthers, Jr. et al. |
| 5,899,605 | A | 5/1999 | Caruthers, Jr. et al. |
| 6,052,195 | A | 4/2000 | Mestha et al. |

OTHER PUBLICATIONS

Z. Wicks, et al., "Color and Appearance: II", *J. of Coatings Technology*, vol. 73, No. 918, Jul. 2001, pp. 73–81.

*Primary Examiner*—Charles H. Nolan, Jr.
(74) *Attorney, Agent, or Firm*—Oliff & Berridge, PLC

(57) ABSTRACT

Computer controller mixing of customer-selected colorants, including inks, for printing machines includes an ink supply station with a color matching control computer program, an ink mixing station, cleaning and waste disposal stations, for automatically emptying and cleaning ink mixing station components, which are integrally connected to a print engine, and scheduling of colorant changes to maximize use of a particular colorant and minimize colorant changes.

69 Claims, 4 Drawing Sheets

COMPUTER CONTROLLED MIXING OF CUSTOMER-SELECTED COLOR INKS FOR PRINTING MACHINES

BACKGROUND OF THE INVENTION

1. Field of Invention

This invention relates to a development system for creating color output images in a printing machine.

2. Description of Related Art

High-end printing includes not only process color, i.e., color produced by overlapping halftone patterns of cyan, magenta, yellow, and/or black inks), but also customer-selected spot colors. Customer-selectable color printing materials, including print media, printing inks and developing materials, can be manufactured by determining precise amounts of constituent basic color components making up a given customer-selectable color material, providing precisely measured amounts of each constituent basic color component, and thoroughly mixing these color components. This process is commonly facilitated by reference to a color guide or swatch book containing hundreds or even thousands of swatches illustrating different colors, where each color swatch is associated with a specific formulation of colorants. Probably the most popular of these color guides is published by Pantone®, Inc. of Moonachie, N.J.

Offset and gravure presses print solid layers of these mixed colorants to match the customer-selected color specified by a Pantone® number. Printing solid layers of inks mixed from a large set of primaries has several advantages over process color printing. For example, many colors can be produced which are outside the color gamut of process color printing. More precise color control and matching is possible with a large set of component colors, since often, a component color is close to the customer-selected color. Additionally, there are fewer sources of color variation with a large set of component colors than there are in a color produced by overprinting several separate colors. Also, fine lines and fonts appear smoother when printed as a solid ink layer than as a halftone pattern. Still further, the solid ink layer resulting with a large set of component colors will appear less grainy than a halftone pattern. Because of the importance of customer-selected color to high-end printing, the color management systems for both a Windows® and Macintosh® operating system provide processes for specifying customer-selected colors by number, and for passing this information to printers. Similarly, all major personal computer graphics software packages which can output color information directed to preparing printing plates provide methods of specifying Pantone® colors.

Customer-selectable spot color is especially important in wallpaper and fabric printing. In these areas, halftoning and process color are uncommon. Instead, all colors are produced by spot colors. A wallcovering, for instance, may have eight colors in its pattern, printed by eight gravure rolls, each containing a separate spot color.

Currently, customer-selectable spot color processing methods involve a human operator mixing customer-selected inks according to predetermined formulas, such as those provided by the Pantone® CMS. In various exemplary embodiments, these formulas specify weight fractions of each component to be combined to make the customer-selected color. The human operator weighs out the component inks and combines them by hand. Typically, the combination is done with a spatula, on a marble slab. Because printed color depends on both the inks used and the substrate on which they are printed, the human operator will frequently deposit a draw-down layer of ink on the target substrate and a make a visual comparison to the customer-selected color.

Computer mixing systems also exist that direct the above steps and calculate each ink adjustment based on tristimulus value differences ($\Delta X$, $\Delta Y$, $\Delta Z$) between a current color and a target color, as disclosed by Z. W. Wicks, et al. in Journal of Coatings Technology, Vol. 73, No. 918, July 2001. However, Applicants are unaware of a system that automates color mixing in the print engine.

SUMMARY OF THE INVENTION

In view of the conventional techniques discussed above, new systems and methods for integration of customer-selectable ink mixing with a computer control system and an automated printer are desirable.

This invention separately provides systems and methods that create colorant mixtures based on a number of target colors, where the target colors may be one or more colorants, per se, or a medium colored by or printed using one or more colorants.

This invention separately provides an ink supply station including a color control computer program, an ink mixing station, and, optionally, cleaning and waste disposal stations integrally connected to a print engine.

This invention separately provides systems and methods for efficiently using a colorant supply and mixing system to produce color matches for a plurality of target colors in an order which optimizes colorant usage.

This invention separately provides systems and methods for efficiently scheduling color matching of target colors to optimize the accuracy of color matches.

This invention separately provides systems and methods of efficiently using a limited number of colorant containers to accurately match target colors using a number of colorants which exceeds the limited number of colorant containers.

This invention separately provides systems and methods of accurately matching a number of target colors by integrating mixing of colorants similar to the Pantone® primaries with a computer color controller and print engine.

This invention separately provides a method of automating the mixing of component colors to match a customer-selected color.

This invention also includes methods for automating the emptying, cleaning, and refilling of the mixed colorant supply chamber when the customer-selected color changes.

This invention separately provides an ink supply station which accepts a color specification from the print engine's control system, automatically mixes a combination of colored inks to match a customer-selected color, and delivers the mixed colorant to the print engine.

In various exemplary embodiments of the systems and methods according to the invention, the ink mixing station can accommodate two or more containers of component colors, as well as optional dispersants and other ink components. The ink mixing station also includes an ink supply chamber in which the component colors are mixed, valves and connectors for adding the components to the ink supply container, a connector for supplying the ink to the print engine, and, optionally, a connector to return unused ink to the ink supply container.

In various exemplary embodiments, the color control computer program takes as input a customer-selected color, such as, for example, a color specified by the Pantone®

Color Matching System, to be printed by the print engine and outputs signals to the ink mixing station which cause mixing of component colors to be mixed to make a mixed color matching the customer-selected color. The systems and methods of this invention may optionally include waste disposal and /or cleaning stations. The ink supply station according to this invention may automatically empty and clean the mixed colorant supply chamber.

In various exemplary embodiments of the systems and methods according to the invention, an ink mixing system, and the print engine are controllably integrated in a way that is unlike any method used in the offset, gravure, flexographic, dry xerographic, liquid xerographic, or ink jet printing fields. The systems and methods according to the invention also include novel color changing methods and novel methods to utilize and exploit certain substrate properties, beyond the conventional methods used to control colorant mixing.

In various exemplary embodiments of the systems and methods of this invention, the ink supply station provides a mixed colorant whose color matches a customer-selected ink color. In various exemplary embodiments of the systems and methods of this invention, the ink supply station provides a mixed colorant which, when printed on the customer-selected substrate, matches the customer-selected printed color. The ink supply station includes a color controller program and an ink mixing station. The color controller receives as an input a customer-specified color. The color controller directs the ink mixing station to mix component colors in specific amounts, resulting in the customer's specified color.

The systems and methods according to the invention encompass any kind of ink and/or printing media or substrate which may be combined and printed, and all kinds of print engines which may use these mixed colorants to match customer-selected colors. While this invention explicitly applies to the mixing of color marking materials for lithography, offset lithography, gravure, flexography, silk screen, letterpress printing ink jet printing and to the mixing of liquid or dry xerographic toners for ionographic or xerographic printing, it should be appreciated that computer-controlled mixing to match customer-selected colors according to this invention can be used with other types of colorants or color marking materials and/or printing media or substrates and methods, and the like. Accordingly, when the application refers to inks, it is to be understood to refer to any type of colorants or color marking materials.

These and other features and advantages of this invention are described in or are apparent from the following detailed description of the preferred embodiments.

BRIEF DESCRIPTION OF THE DRAWINGS

Various exemplary embodiments of this invention will be described in detail with reference to the following figures, wherein like numerals represent like elements and wherein.

DETAILED DESCRIPTION OF THE EXEMPLARY EMBODIMENTS

Figure 1:
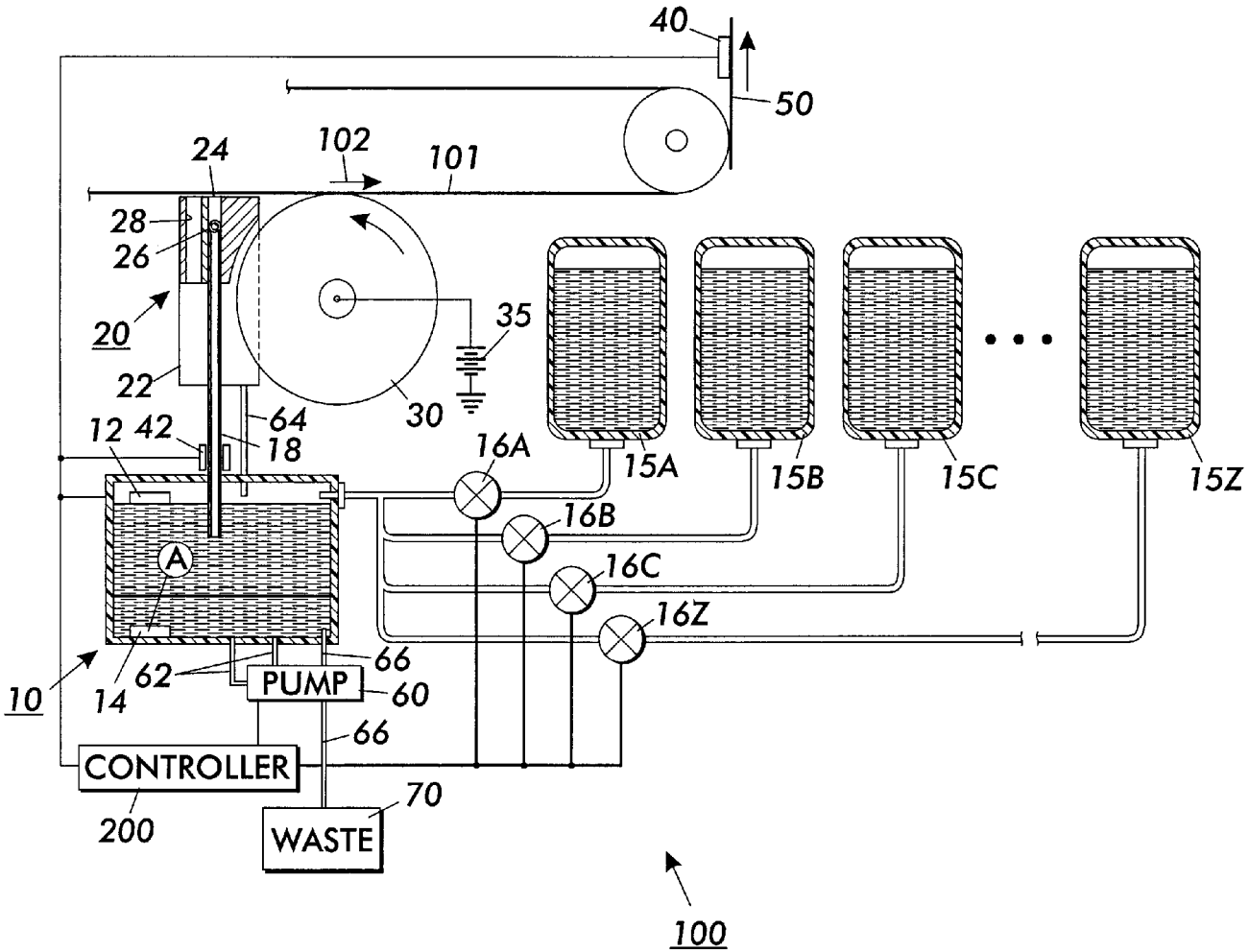
FIG. 1 is a simplified elevational view of a liquid-based printing apparatus, as would incorporate the system of this invention.

One application of the computer-controlled mixing of customer-selected color inks, for example, can be accomplished according to this invention by a color control system residing in the print engine's control system. The color control system may reside at or within the print engine's control system or the color control program may be, for example, part of a detachable ink supply station which takes target color specifications from the printer engine's control system. In either case, a print command may be received from incoming print description, such as from an Adobe® PostScript image file. If the color control system is an integral part of the print engine, the color control system can be coordinated when scheduling print jobs, resulting in, for example, minimizing wasted mixed color inks contaminated during switching between different colored inks.

The customer-selected color may be, for example, specified by number, defined in a specification system such as the Pantone® Color Matching System (CMS), or by coordinates in some color description coordination and/or space, such as CIELAB's L*a*b* coordinates. Other inputs to the color control system may include, for example, certain specifications or characteristics of a particular substrate onto which the color will be printed. These inputs may be accomplished, for example, by selection from a list, properties sensed off-line, and/or by appropriate sensors within the print engine.

Converting a customer-selected color into one or more appropriate commands for the colorant mixing system may be given, for example, by a look-up table, in which each specifiable color is associated with a resulting set of commands for the ink mixing station. Additionally, commands for the colorant mixing system may be provided, for example, by a lookup table in which each specifiable color is associated with target feedback from sensors in at least one or more of the ink supply, some part of the printing system, and/or the color appearing on the final printed substrate. Further, commands for the colorant mixing system may be obtained, for example, by interpolating between entries in a lookup table, where that lookup table is smaller than the total number of specifiable colors. Additionally, commands for the colorant mixing system, may be generated by calculation of the amounts of component colors to be mixed, using the customer-selected color and the colors of the components, or by combination of two or more conversion methods. In particular, converting the customer-selected color may, for example, modify the component colors used and their concentrations in the ink supply by considering properties of the substrate onto which the ink will be printed and/or the measured color characteristics of the final print.

The commands to the colorant mixing system direct the addition of as many components as necessary, in the specific amounts, to create the customer-selected color. The components can include one or more primary colors, required for the constituent inks, from which the customer-selected color will be mixed. The components can also include a previous custom mixed colorant whose color can be modified to make the next ink. The components may also include, for example, other materials necessary for printability, such as carriers, flow modifiers, conductivity modifiers, and/or any other known or later-developed ink additives. Adding individual components may be made, for example, by precisely actuating and deactuating one or more pumps, and/or opening and closing one or more valves to coordinate the time period for the added components.

The commands to the colorant mixing system may be modified, for example, by feedback from sensors associated with the mixed colorant supply chamber and/or component of the supply containers and/or associated with other parts of the print engine. Commands to the ink mixing station will normally include, for example, notifications to the print engine's operator when component supplies must be replaced or replenished. In various exemplary embodiments which use fewer component color containers than the total number of component colors available, the user can be notified when different components are needed.

The feedback to the color control system may include, for example, one or more of the volume of the ink in a mixed colorant supply chamber and/or one or more ink component supply containers, the weight of the ink in the mixed colorant supply chamber and/or one or more ink component supply containers, the color of the ink in the mixed colorant supply chamber and/or one or more ink component supply containers, the color of the ink layer printed on the final substrate, or the color of the ink layer on some internal member, dependent on the printing process of the particular printer. The feedback to the color control system can also include non-color properties of the ink which effect its printability including, for example, temperature, pH, viscosity, specific gravity, solids concentration, charge density, conductivity, and/or the concentrations of individual components.

The color of the ink in the mixed colorant supply chamber may be measured optically using, for example, either light reflected from the ink surface, which is especially useful for dry xerographic powders or for very concentrated liquids, or light transmitted through a controlled thickness of the liquid ink. The color of an ink layer may be measured, for example, by reflecting a light source off of the ink layer and off of an un-inked portion of the same surface, and comparing the two reflected intensity values of the returning light. The color of the ink printed on the final substrate can be measured, for example, continuously during printing by a sensor which is an integral part of the printer, or, for example, by an operator who checks the resulting color as printed on the substrate using a spectrophotometer, a colorimeter, a photometer, or the like.

Systems and -methods for using the color of the mixed colorant as it appears or when applied onto a given substrate to adjust the component composition (including the specific components and the amounts of any component) is described in U.S. Pat. No. 5,713,062, incorporated herein by reference in its entirety. Further, when this sensor is part of the print engine, the color measurements may be provided, for example, directly to the color control computer program. Additionally, when the user of the print engine checks the color, the color measurements may be provided, for example, directly to the color control system from the measurement device, or manually by the operator entering values (such as L*a*b* values) through a user interface of the print engine or the color control system.

Color sensors, suitable for measuring ink supply color and ink layer color, will normally measure transmission or reflectivity in at least three wavelengths or wavelength regions. Suitable sensors for measuring ink supply color and ink layer color include spectrophotometers and colorimeters. Colorimeters typically comprise a white light source, a rotating set of filters, and a photodetector, or a plurality of colored light sources, such as LEDs or laser diodes, and one or more photodetectors, usable to measure the reflection or transmission of light from those sources. The color measurements associated with these sensors may be performed, for example, automatically, by locating sensors in the ink mixing system or in the print engine, or using operator measurements of the final printed color or of the color of ink samples drawn from the mixed colorant supply chamber.

FIG. 1 shows one exemplary embodiment of a colorant mixing system in which the ink is liquid electrophoretic toner transported from a supply reservoir 10 to a latent image on a photoreceptor 101 by an applicator 20. The supply reservoir 10 acts as a holding receptacle to provide a liquid developer comprising a liquid carrier, a charge director compound and toner material which, in the case of a customer selectable color application of the present invention includes a blend of different colorant toner particles. A plurality of replaceable supply dispensers 15A–15Z, each containing a concentrated supply of toner particles and carrier liquid corresponding to a basic color component in a color matching system, are provided in association with the operational supply reservoir 10 and coupled to the operational supply reservoir 10 as will be described.

An exemplary developing material applicator 20 includes a housing 22, having an elongated aperture 24 extending along a longitudinal axis of the housing 22 so as to be oriented transverse to the surface of the photoreceptor 101, along the direction of travel of the photoreceptor 101 as indicated by the arrow 102. The elongated aperture 24 is coupled to an inlet port 26 which is further coupled to the supply reservoir 10 by a transport conduit 18. The transport conduit 18 operates in conjunction with the aperture 24 to provide a travel path for liquid developing material transported from the supply reservoir 10 and also to define a developing material application region in which the liquid developer can freely flow to contact the surface of the photoreceptor 101 to develop the latent image on the photoreceptor 101. Thus, liquid developing material is pumped or otherwise transported from the supply reservoir 10 to the applicator 20 through at least one inlet port 26 such that the liquid developer flows out of the elongated aperture 24 and into contact with the surface of the photoreceptor 101.

Slightly downstream of, and adjacent to, the developer applicator 20, in the direction of movement of the photoreceptor 101, is an electrically biased developer roller 30. The peripheral surface of the electrically biased developer roller 30 is situated in close proximity to the surface of the photoreceptor 101. The developer roller 30 rotates in a direction opposite to the movement of the photoreceptor 101 to apply a substantial shear force to the thin layer of liquid developer present in the area of the nip between the electrically-biased developer roller 30 and the photoreceptor 101. The shear force is applied to minimize the thickness of the liquid developer on the surface thereof.

This shear force removes excess liquid developing material from the surface of the photoreceptor and transports this excess developing material in the direction of the development station 20. The excess developing material eventually falls away from the rotating metering roll for collection in the chamber 10 or a waste sump 70. A DC power supply 35 is also provided to maintain an electrical bias on the electrically biased developer roller 30 at a selected polarity and magnitude such that the image areas of the electrostatic latent image on the photoconductive surface will attract marking particles from the developing material for developing the electrostatic latent image. The electrophoretic development process minimizes the existence of marking particles in background regions and maximizes the deposit of marking particles in image areas on the photoreceptor.

The supply reservoir or chamber 10 is also coupled by a recirculation hose 62 and a portion of a supply emptying hose 66 to a pump 60. The pump 60 operates, for example, to circulate the contents of the supply chamber 10 through the recirculation hose 62, as necessary, to keep the contents of the supply chamber 10 uniformly mixed. Additionally, for example, the pump 60 also draws the contents of the supply chamber 10 into the supply emptying hose 66, and, as necessary, may deposit the contents of the supply chamber 10 into the waste container 70.

In operation, liquid developing material is transported in the direction of the photoreceptor 101 filling the gap between the surface of the photoreceptor 101 and the liquid development station 20. As the photoreceptor 101 moves in the direction of the arrow 102, a portion of the liquid developing material in contact with the photoreceptor 101 moves with the photoreceptor 101 toward the developer roller 30, where marking particles in the liquid developer material are attracted to electrostatic latent image areas on the photoreceptor 101. The electrically-biased developer roller 30 also removes excess liquid developing material adhering to the photoconductive surface of the photoreceptor 101 and acts as a seal to prevent extraneous liquid developing material from being carried away by the photoreceptor 101.

As previously indicated, the liquid developing materials of the type suitable for the electrostatographic printing applications generally comprise particles and charge directors dispersed in a liquid carrier medium, with the operative solution of the developing material being stored in the supply chamber 10. Generally, the liquid carrier medium is present in a large amount in a liquid developing material composition, and constitutes that percentage by weight of the developer not accounted for by the other components. The liquid medium is usually present in an amount of from about 80% to 99.5% by weight, although this amount may vary from this range provided that the objectives of this invention can be achieved.

This present invention, however, contemplates a developing material replenishing system capable of systematically replenishing individual color components making up a customer-selectable color developing material composition. As such, the replenishment system of the present invention includes the plurality of differently colored concentrate supply dispensers 15A, 15B, 15C, . . . 15Z, at least a pair of which are coupled to the operative supply reservoir 10 via an associated valve member 16A, 16B, 16C, . . . 16Z, or other appropriate supply control device. Preferably, each supply dispensers 15A–15Z contains a developing material concentrate of the known basic or primary color component used in a given color matching system. It will be understood that each of the plurality of supply dispensers 15A–15Z may be coupled to the supply reservoir 10, or only selected supply dispensers may be coupled to the supply chamber 10. For example, under certain circumstances, such as space constraints or cost restraints, it may be desirable to use only dispensers 15A, 15B and 15C, making up a simplified color matching system.

A color control system using a controller 200 as a component of the developer color mixing and control system of this invention determines appropriate amounts of each color liquid developer in each supply container 15A–15Z, to be added to the supply chamber 10, and to make other determinations and control various functions, as discussed in more detail, below. The controller 200 may take the form of any known or later-developed microprocessor- or microcontroller-based memory and processing device, as are well known in the art.

The supply chamber 10 also contains at least three sensors or sensing devices. In various exemplary embodiments, the at least three sensors include a float sensor 12, a conductivity sensor 14 and a color sensor 42. The float sensor 12 operates in relationship to a predetermined fill level "A". The placement of fill level A, may be, for example, fixed within the supply chamber 10, or may be adjustable to any vertical placement within the supply chamber 10. The float sensor 12 is electronically coupled to the controller 200, and will communicate when the float sensor 12 drops below or rises above the predetermined level A, or to communicate the sensed fill level accordingly. The conductivity sensor 14 is also electronically coupled to the controller 200, and will communicate when the conductivity sensor 14 drops below or rises above a predetermined level, or to communicate the sensed conductivity accordingly. The color sensor 42 is also electronically coupled to the controller 200, and will communicate a sensed optical density, and/or a sensed color to the controller 200.

The controller 200 controllably directs the filling, emptying, cleaning and/or replacing of the supply dispensers 15A–15Z for amounts of components into the supply chamber 10. The controller 200 also directs uniform mixing of components in the supply chamber 10, and supply of the colorant mixed in the supply chamber 10 to the printer, and/or returning unused ink from the printer to the supply chamber 10. The ink mixing system may further contain sensors, such as those described above, which provide information to the color control system.

In order to change from one mixed color to another, the supply chamber 10 may be drained, and flushed with a cleaning solution (which may be another colorant or diluent) if necessary or desired. Cleaning of the supply chamber 10 and any associated lines connected to the supply chamber 10, may be required or desired so that residual mixed colorant does not contaminate or react with a replacement colorant.

Then colorants may be added to the supply chamber 10 to form the next customer-selected color in the supply chamber or reservoir 10. Emptying and cleaning of the supply dispensers 15A–15Z or of the supply chamber or reservoir 10 may be, for example, performed manually, after an ink supply dispenser 15 has been removed from the colorant mixing system. In various exemplary embodiments, this invention may include, for example, replaceable and/or disposable colorant supply chambers 15A–15Z used to deliver inks for an ink jet print engine. The supply chamber 10 may be in the form of a replaceable cartridge. The colorant supply chambers 15A–15Z may be discarded and replaced by other colorant supply chambers 15 or cartridges 15.

However, in various other exemplary embodiments of this invention, such as when used with a xerographic or ionographic print engine, a used supply chamber 10 may be returned to the factory for charting and recovery of unused ink. In other exemplary embodiments of the invention, for example, it is preferable to automate cleaning by including a waste container and a cleaning station as part of the color mixing system. Additionally, with powder or other dry inks, diverter blades or rolls may be used, for example, to move the waste mixed colorant powder to a waste container from the supply chamber 10 and/or the associated color print station of the print engine.

With liquid inks, such as lithographic, gravure, flexographic, silk screen inks, or liquid xerographic inks, a cleaning station may be provided, for example, with a cleaning fluid, which is used to wash the unused mixed colorant out of the supply chambers 10 and/or the associated color print station. When used with a liquid ink system, the waste container 70 may be, for example, connected to the cleaning fluid container to clean the pigmented solids and/or other components from the waste liquid ink. In a liquid ink system, with a waste container 70 and cleaning fluid containers (not shown) interconnected, the controller 200 of the color control system 100 also controls valves that empty ink from the supply chamber 10 into the waste container 70 and refill the supply chamber 10 with cleaning fluid. Some methods of automatically cleaning a liquid xerographic print station which apply to color changes are described in, for example, U.S. Pat. No. 5,634,170, incorporated herein by reference in its entirety. Adding components to make the next mixed colorant having the next customer-selected color can be controlled by any of the conversion methods described below.

The color mixing system can also allow one or more of the component supply dispensers 15A–15Z to be replaced with different component supply dispensers 15. This allows the range of mixable colors to be increased without increasing the complexity of the ink transport system, but may require the ink transport system to be at least partially cleaned or flushed after one component supply dispenser 15 is connected to the color mixing system. FIG. 1 shows an exemplary apparatus for developing an electrostatic latent image, using liquid developing materials, which is described in detail, herein.

Typically, a highlight color electrostatographic printing machine would include at least two developer devices operating with different color liquid developing materials for developing latent image areas into different colored visible images. By way of example, in a tri-level system of the type described below, a first developer unit might be utilized to develop the positively charged image area with black colored liquid developing material, while a second developer unit might be used to develop the negatively charged image area with a customer selected color. In the case of liquid developing materials, each different color developing material comprises pigmented toner or marking particles, as well as charge control additives and charge directors, all disseminated throughout a liquid carrier. The marking particles are charged to a polarity opposite to the polarity of the charged latent image to be developed.

The developer unit shown in FIG. 1 operates primarily to transport liquid developer material into contact with a latent image on the surface of the photoreceptor 101. The marking particles are attracted, via electrophoresis, to the electrostatic latent image on surface of the photoreceptor 102 to create a visible developed image on the surface of the photoreceptor 102. Where more than one developer unit is used, the basic manner of operation of each developer apparatus is generally identical to one another.

The developer unit shown in FIG. 1 represents only one of various known developer devices that can be used to apply liquid developing material to the photoconductive surface. It will be understood that the basic development system incorporating the mixing and control system of this invention may be directed to either liquid or dry powder development and may take many forms, such as, for example, any one of the systems described in U.S. Pat. Nos. 3,357,402; 3,618,552; 4,733,273; 4,883,018; 5,270,702 and 5,355,201 among numerous others. Such development systems may be utilized in a multicolor electrophotographic printer, a highlight color printer, or in a monochromatic printer. In general, the only distinction between each developer unit is the color of the liquid developing material in any particular developing unit. It will be recognized, however, that only developer units that are to be provided with the capability to generate customer-selectable color developer materials will be provided with the customer-selectable color mixing and control system of this invention.

In one specific embodiment, the replenishment system includes sixteen supply dispensers, wherein each supply dispenser provides a different base color developing material corresponding to the sixteen basic or constituent colors of the Pantone® Color Matching System, such that color formulations conveniently provided thereby can be utilized to produce over a thousand desirable colors and shades and a customer-selectable color printing environment. The replenishment colors, also known as color concentrates, include both a transparent white, which is usable to produce lighter colors on white substrates or transparencies without halftoning or reducing developed mass per unit area (DMA) and an opaque white. Opaque white is used to create whiter or lighter colors on colored papers, brown paper bags, etc.

The mixed colorant is made from carrier fluid, charge director solution, and one or more component color materials. The component color materials have higher solids concentrations, generally 10–50% by weight, than the mixed colorant to be supplied to the printer. Similarly, the charge director solution has higher charge director solids concentration, generally 1–10% by weight, than is present in the mixed colorant which is supplied to the printer. The system adds carrier, charge director solution, and one to four component color concentrates to the supply chamber 10, as directed by the color controller 200. Using this system, as few as two different color component materials, such as from one or more from supply dispensers 15A and 15B, can be combined in the supply chamber 10 to expand the color gamut of the customer-selectable colors far beyond the colors available via halftone imaging techniques or even the colors available from mixing just yellow, magenta, cyan and black color developing materials.

Since different components of the blended or mixed developing material in supply chamber 10 may develop at different rates, the controller 200 determines appropriate amounts of each color developing material in the component supply dispensers 15A, 15B . . . or 15Z that may need to be added to the supply chamber 10. The controller 200 controllably operates each of the valves 16A–16Z to supply appropriate amounts of one or more of the different colorant developing material contained in the component supply dispensers 15A–15Z.

Figure 2:
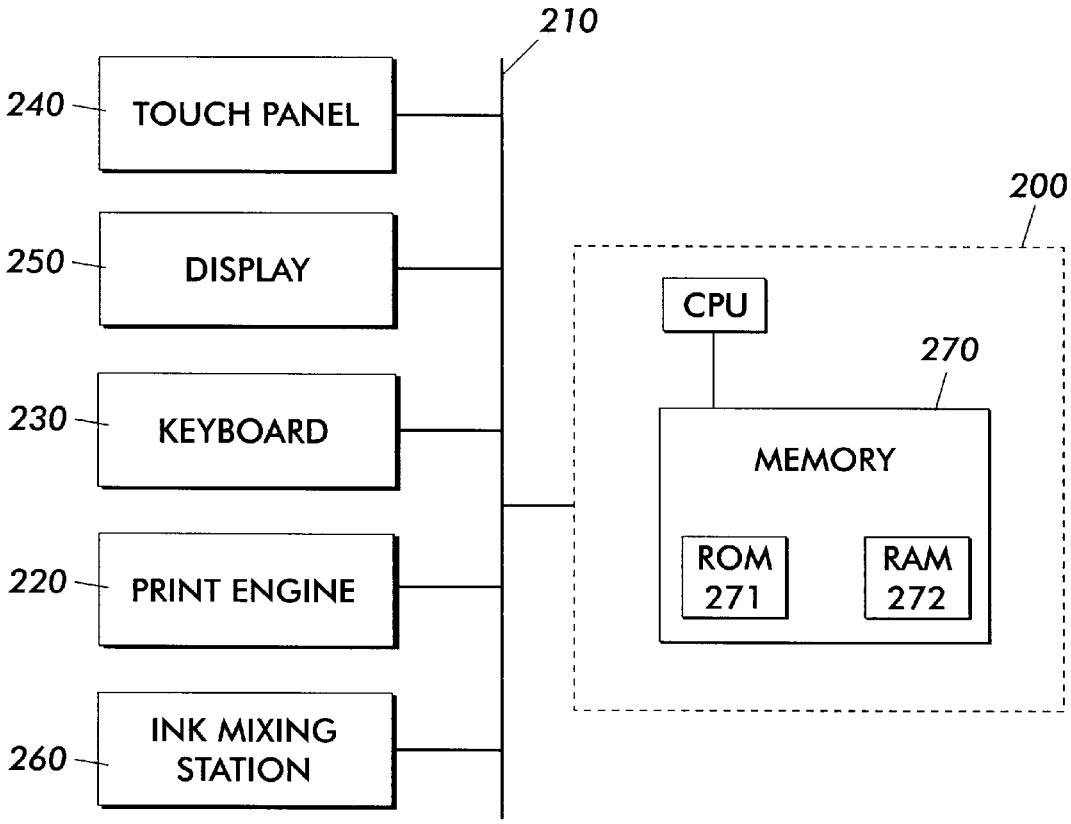
FIG. 2 shows in greater detail one exemplary embodiment of the controller of FIG. 1.

The controller 200 may be, for example, directly connected to the printer's print engine control program, which may, for example, accept an input image and identifies the custom color which the customer has specified. The custom color may be specified, for example, as a coordinate-based number from the Pantone® CMS to the color controller 200 via a keyboard 230 or a touch screen 240, shown in FIG. 2. The color controller 200 contains a color look-up table, which may be located in a ROM portion 271 or a RAM portion 272 of the memory 270. For each coordinate-based number in the Pantone® CMS, the color look-up table includes an entry that has fields for one or more of (1) a list of component color concentrates to be used, (2) a volume of each component color concentrate to add to the supply chamber 10 when the ink supply chamber is to be filled by a new mixed color, (3) a carrier fluid volume to add when the supply chamber 10 is to be filled by a new mixed color, (4) a charge director concentrate volume to add when the supply chamber 10 is to be filled by a new mixed color, (5) a volume of each component color concentrate to add when the overall optical density of the ink supply drops below a predetermined lower level, (6) a measure of the target color to be matched, e.g., its transmission spectrum or its reflection spectrum, by the mixed color, and/or (7) a set of characteristics of the component colors, e.g., their absorption spectra.

The absorption spectra for the component colors are measured and controlled in the process used to manufacture the component color concentrates. The volume of each component color concentrate to add to the supply chamber 10 may be, for example, determined empirically for each customer-selectable color, by printing different mixtures of the component colors onto the paper or other final substrate used in this printer. An additional amount of each component color concentrate required to add when the overall optical density of the ink supply drops below the predetermined lower level may be, for example, also determined empirically, by coating the paper with different amounts of the component colors. In this way, the supply chamber 10 is constantly replenished by component colors in exactly the ratios that are being printed onto a particular substrate. Some methods of color mixing and replenishment methods are described in, for example, U.S. Pat. Nos. 5,899,605 and 6,052,195, each incorporated herein by reference in its entirety. Because there is the possibility that slight errors in the replenishment could lead to a slow drift of component concentrations during very long print runs, the color of the toner supply is measured, e.g., by its transmission spectrum, and compared to the target color throughout the print run. The same color correction methods that are used to prepare the initial mix of primaries can be used to correct the mix during printing.

The difference between the target and actual transmission spectra may be, for example, determined and combined with the absorption spectra to calculate the concentrations of each component color in a particular quantity mixed toner. Some methods by which these calculations can be done are described in, for example, U.S. Pat. Nos. 5,897,239 and 6,052,195, each incorporated herein by reference in its entirety.

Figure 3:
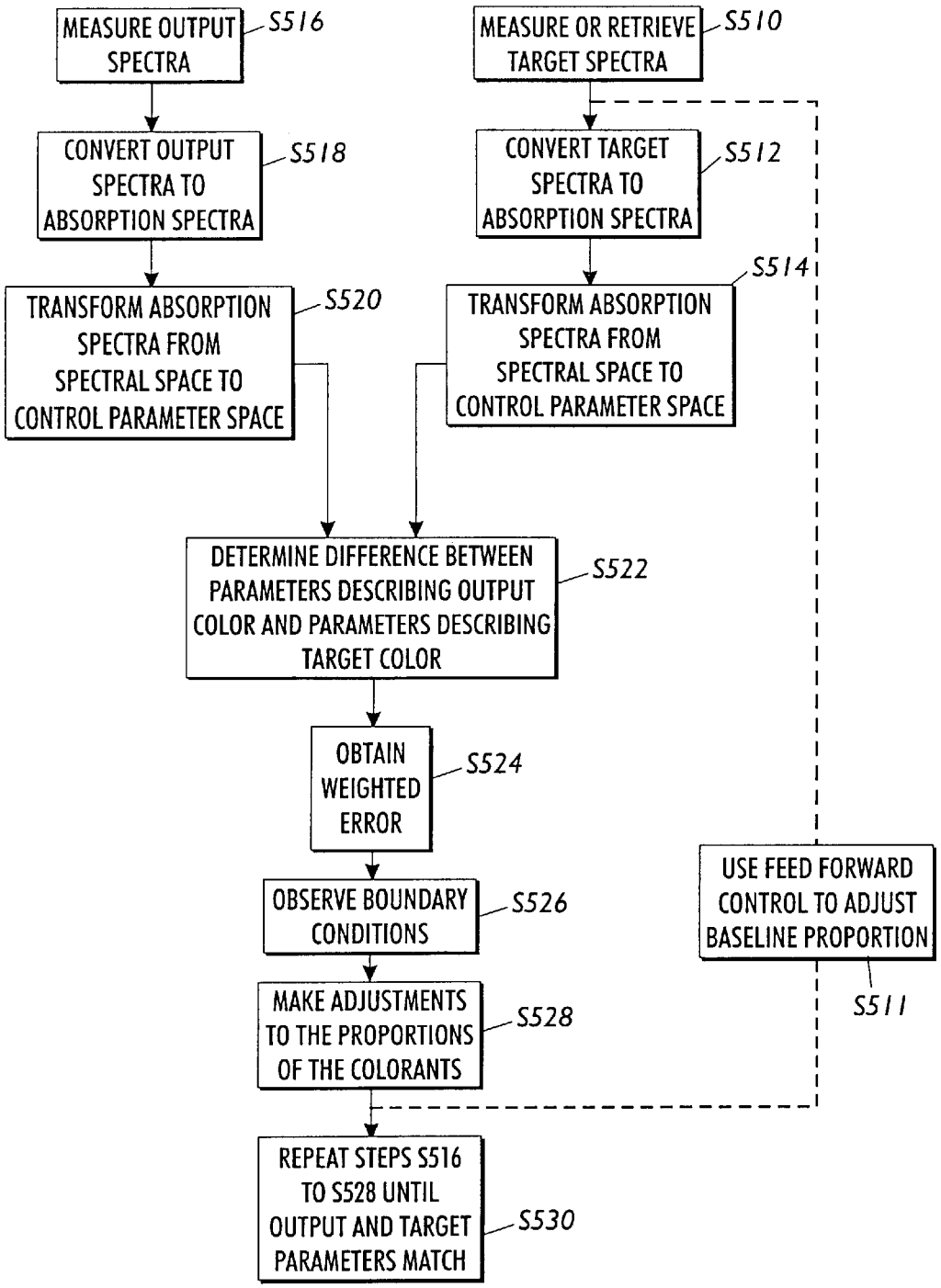
FIG. 3 is a flowchart outlining one exemplary embodiment of a process of color matching a single target color according to this invention.

FIG. 3 is a flowchart outlining one exemplary embodiment of a method for producing a color match of a single target color according to this invention. FIG. 3 is fully described in U.S. Pat. No. 6,052,195. The method outlined in FIG. 3 is used in the systems and methods of this invention to both determine which colorants are needed to match all of the target colors selected by a user such as, for example, a customer, and to provide a match for all of the target colors. These steps will be outlined below.

Beginning in step S500, operation continues to step S510 where the transmission spectra of a target color is determined. For example, the transmission spectra may be measured using a recording spectrophotometer, or obtained from memory, or downloaded from the Internet or other source. If the target spectrum is measured, it is beneficial to also store the target spectrum in memory. Next, in step S511, feed forward control is used to adjust the baseline proportions based on the measured or retrieved target spectra. Then, in step S512, target color spectra are converted to absorption spectra. Operator then continues to step S514.

In step S514, the target absorption spectrum is transferred from a spectral space to a control parameter space. Details of this transfer are set forth in the incorporated '195 patent. Alternatively, the process steps of S510, S512 and S514 can be combined into a single step, as set forth in the incorporated '195 patent.

In steps S516–S520, the output spectrum is measured and converted to an absorption spectrum A, which is then transformed into measured control parameters, similarly to steps S510–S514. Operation then continues to step S522.

In step S522, the control parameters describing the output color are compared to the control parameters describing the target color. Specifically, an error E representing the difference between the parameters describing the output color and the parameters describing the target color is determined. Operation then continues to step S524.

In step S524, the incremental proportions by which each constituent color must be adjusted are computed as set forth in the '195 patent. Operation then continues to step S526.

In step S526, the incremental proportions are evaluated to ensure all appropriate boundary conditions are satisfied. The proportion adjustment values are then determined. In determining which colorants are needed to match all target colors, the proportion adjustment values need not be transmitted to the supply chamber 10. However, to actually match a target color, the proportion adjustment values are transmitted to the supply chamber 10.

Then, in step S528, the process outlined in steps S516–526 is iterated until convergence occurs.

Then, in step S530, signals representing the adjustments to be made to the proportions of the colorants are stored in a list of colorants needed to match a particular target color. When determining the component colors needed to match all of the target colors, step S530 need not be repeated or may be repeated a predetermined minimal number of times. When making an actual color match, the adjustment signals are sent by the controller 200 to the colorant mixing valves to mix the selected colorants in the proper proportions to make a color match.

In various exemplary embodiments, the color control system is part of the general control system of the print engine. From within the print engine's control computer, the color control computer program is used to schedule jobs in an order related to the customer-selected colors the scheduled jobs require.

Figure 4:
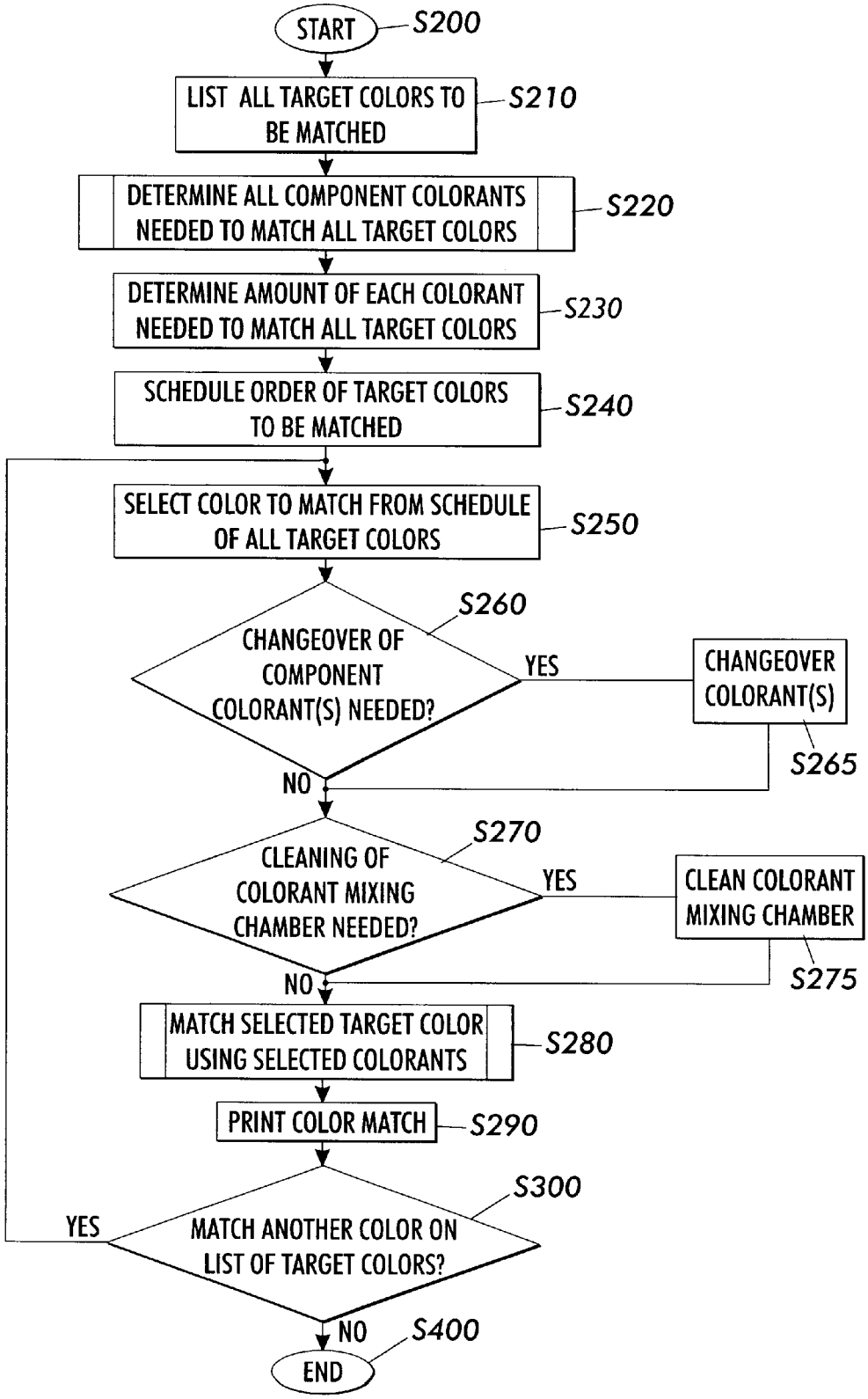
FIG. 4 is a flowchart outlining one exemplary embodiment of a process for color matching a number of different target colors according to this invention.

FIG. 4 is a flowchart outlining one exemplary embodiment of this operation. Beginning in step S200, operation continues to step S210, where all target colors which are to be matched are listed. These target colors may have been inputted via the keyboard 230. Then, in step S220, all component colorants needed to match the target colors are determined for each target color. One method of doing this is found in FIG. 3, as discussed above. The steps set forth in FIG. 3 are discussed in greater detail in the incorporated '195 patent. This results in a determination of the target color parameters and the colorant color parameters required to match each target colors.

Next, in step S230, the amount of each colorant needed to match each of the target colors is determined. This lists reflects all of the colorants, such as, for example, 12 of the 16 Pantene® colors, which will be needed to match all of the target colors. Operation then continues to step S240.

In step S240, the order of target colors to be matched is scheduled. Next, in step S250, a target color to match is selected or obtained from the schedule of all target colors. The scheduling may be based on several factors, including for example, (1) the amount of each colorant needed to match all target colors; (2) a ranking of which colorants are used in target color matches from use in the most target color matches to use in the fewest target color matches; (3) a ranking of the number of colorants needed for each target color match from the largest number of colorants to the fewest number of colorants; and (4) a list of the fewest number of changeovers of colorants are needed to match all of the target colors.

In one exemplary embodiment according to the systems and methods of this invention, print jobs which require the same customer-selected color are grouped and scheduled together. Print jobs which require similar colors are grouped together and ordered so that new component color concentrates can be added to the existing mixed colorant supply, without having to first empty the supply chamber 10. For example, a print job for a yellow ink color will be processed before an orange ink color, which may, for example, be followed by a red ink color. By processing the print jobs in this order, for example, only red and/or magenta ink has to be added to make each color change. In another exemplary print job sequence, a light blue ink print job will be processed before a dark blue ink print job, so that only dark blue and/or black concentrates, or the equivalent, have to be added to make the particular color change.

Then, in step S260, once a target color to match has been selected, a determination is made whether a changeover of component colorants is needed. This decision is based on the number of colorant supply tanks 15A–15Z, and the number of colorants needed to match all of the target colors. If the number of colorants is the same as, or fewer than the number of supply tanks, then there should be no need for a colorant changeover. However, if the number of colorants is greater than the number of colorant supply tanks, then there will be a need for one or more colorant changeovers or for replacement of one or more of one or more of the supply dispensers 15A–15Z.

If a changeover of component colorants is needed, control goes to step S265, where one or more component colorant containers are changed. Control then continues to step S270. If a changeover of component colorants is not needed, control jumps directly from step S260 to step S270.

In step S270, a determination is made whether cleaning of the colorant mixing system is needed. If the supply chamber 10 needs to be cleaned, control jumps to step S275. Otherwise, in step S270, if cleaning of the colorant mixing system is not needed, control jumps directly to step S280. In step S275, the supply chamber 10 is cleaned. This cleaning may also involve cleaning supply lines from component colorant containers to the supply chamber 10 and, where permanent component colorant containers are used as the dispensers 15, cleaning of one or more of the dispensers 15. When the cleaning of the colorant mixing system is completed, control goes to step S280.

In step S280, the selected target color is matched with the selected colorants. Details of this matching are set forth in FIG. 3, and described above. Then, in step S290, once a color match is made, the matched color is printed by the print engine. Next, in step S300, a determination is made whether one or more target colors are on the list of target colors to be matched. If there are one or more such target colors, control jumps back to step S250, where a target color is selected to match. If there are no more target colors to be matched, control goes to step S400, and the process ends.

In the systems and methods according to this invention, the controller 200 continuously monitors the colorants to see if they need to be replenished in terms of amounts of colorant in each supply tank 15A–Z, or amount and strength of colorants added to the supply reservoir 10, and replenishes the colorants as needed. Systems of this type are disclosed in the incorporated '239 and '605 patents.

In another exemplary embodiment of the systems and methods of this invention, it is possible to remove the supply chamber 10 and to save its contents until the same color is again selected. Alternatively, the mixed colorant in the supply chamber 10 can be dumped into a waste container 70. The supply chamber 10 can be washed manually when the next customer-selected color can not be made by adding another colorant to the current mixed colorant material in the supply chamber 10. In this exemplary embodiment, however, the color controller 200 automatically empties the supply chamber 10 by actuating the pump 60, for example, to divert flow from the recirculation hose 62 to the hose 66 leading to the waste container 70. After emptying the supply chamber 10 of any remaining color concentrate mixture, the chamber is refilled by a supply of cleaning fluid. This cleaning fluid is circulated through the recirculation hose 62 and the supply hose 18 leading to the development station of the printer and back through the return hose 64. After a predetermined cleaning period, the pump 60 is again activated to draw the cleaning fluid into the waste container 70. The fluid in the waste container then may be, for example, cleaned and transferred to the cleaning fluid container (not shown). The cleaning is achieved by electrophoretic deposition and need not be complete in order to provide functionally useful cleaning solution. Cleaning might also be achieved by settling, filtration, or some combination of these methods, or the like.

EXAMPLES

A simple method of predetermining mixing ratios corresponding to a target color is shown to demonstrate substrate effects on the final printed color. A target color of Pantone® 151 was selected. Pantone® 151 is an orange which is outside the gamut of process colors (i.e., those made by overlapping halftone patterns of cyan, magenta, yellow, and/or black). The color coordinates (L*a*b*) of both Pantone® 151U and 151C were measured from print samples in the Pantone® Color Selector 1000/Uncoated and the Pantone® Color Selector 1000/Coated color matching guides.

Filtration was used as the method to predetermine the proportions of Yellow and Warm Red liquid xerographic inks necessary to match Pantone® 151 (an orange). Yellow arid Warm Red inks were each diluted to 0.00192 wt % toner solids, for uniform filtration. The target total developed mass per area (DMA) was $0.1mg^{2/}$ cm on a filtration area of 10 $cm^2$. A number of 50 gram samples were prepared by mixing the two toners in proportions shown below. 1.0 mg of each mixture was deposited on a filter paper by filtration. After filtration, each sample was dried and fused in a warm oven for about 30 minutes. After cooling, the color of each sample was measured. The target color to be matched was chosen to be Pantone® 151U because our filter paper is closer in properties to Pantone's uncoated paper than to the coated paper. Comparison to the target color led to selection of 70% Yellow, 30% Warm Red as an optimum match to Pantone 151.

TABLE 1

| % Yellow (mass) | % Warm Red (grams) | L* | a* | b* |
|---|---|---|---|---|
| 80% (40.020 g) | 20% (9.992 g) | 75.50 | 33.20 | 75.60 |
| 75% (37.708 g) | 25% (12.512 g) | 73.52 | 37.62 | 71.48 |
| 70% (34.967 g) | 30% (14.993 g) | 69.95 | 45.99 | 71.86 |
| Target color | Pantone ® 151U | 68.87 | 43.27 | 53.49 |
| | Pantone ® 151C | 64.34 | 50.01 | 80.88 |

Yellow and Warm Red liquid xerographic inks were then mixed in the predetermined 70/30 ratio and added to a Xerox ColorgrafX 8936 printer. This mixed colorant was printed onto Xerox ColorgrafX 6262 dielectric paper. This paper is smooth and coated, but significantly less glossy than the paper used in the Pantone® Color Selector 1000/Coated. The printed color was

| L* | a* | b* | ΔE from 151U |
|---|---|---|---|
| 71.09 | 40.44 | 52.28 | 3.79 |

Because of the differences between the filter paper, dielectric paper actually used, and the paper used in Pantone® Color Selector 1000/Coated, this is actually a better match than was achieved with the filtrations. After lamination, the printed color measured

| L* | a* | b* | ΔE from 151U |
|---|---|---|---|
| 66.31 | 43.84 | 53.75 | 2.63 |

Thus, even laminating to increase gloss does not bring the printed color closer to Pantone® 151C than to Pantone® 151U. This shows the need for careful empirical relations between substrate properties, ink color, and the final printed color.

The disclosed method may be readily implemented as software executed on a program general purpose computer, special purpose computer, a microprocessor or the like. In this case, the methods and systems of this invention can be implemented as a routine embedded on a copier, printer or the like.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method of color matching using colorants supplied to a print engine having a colorant mixing station and at least one colorant supply chamber, comprising:

listing a plurality of target colors to be matched;

listing the colorants needed to match the target colors;

determining the amounts of each colorant needed to make each target color;

scheduling an order of target colors to be matched;

selecting colorants to match each scheduled target color;

mixing the selected colorants; and controllably integrating the previous steps to supply the mixture to the print engine.

2. The method of claim 1, further comprising printing a color match for the first target color.

3. The method of claim 1, further comprising repeating the selecting, mixing and supplying steps for the next scheduled target color.

4. The method of claim 1, further comprising determining if a colorant needs to be replaced by another colorant to match at least one of the target colors.

5. The method of claim 1, wherein the target colored medium is at least one colorant.

6. The method of claim 1, wherein the target colored medium is a medium on which the one or more selected colorants are printed by the print engine.

7. The method of claim 1, wherein determining the color characteristics includes specifying those characteristics in terms of a device-independent color space.

8. The method of claim 7, wherein the independent color space is defined by CIELAB L*a*b* coordinates.

9. The method of claim 1, wherein selecting one or more matching colorants includes using a lookup table in which each matching colored medium is associated with a corresponding set of commands to the colorant mixing station.

10. The method of claim 1, wherein selecting one or more matching colorants includes using a lookup table in which each matching colored medium is associated with colored medium characteristics determined using measured color characteristics of the colorant supply.

11. The method of claim 1, wherein selecting one or more matching colorants includes using a lookup table in which each matching colored medium is associated with colored medium characteristics determined using measured characteristics of the printed colored medium.

12. The method of claim 1, wherein selecting one or more matching colorants includes using interpolation from a lookup table which contains fewer than the total number of colors reproducible by the one or more matching colorants.

13. The method of claim 1, wherein selecting one or more matching colorants includes a combination of two or more of (a) using a lookup table in which each matching colored medium is associated with a corresponding set of commands to the colorant mixing station; (b) using a lookup table in which each matching colored medium is associated with colored medium characteristics determined using measured color characteristics of the colorant supply; (c) using a lookup table in which each matching colored medium is associated with colored medium characteristics determined using measured characteristics of the printed colored medium; (d) using interpolation from a lookup table which contains fewer than the total number of colors reproducible by the one or more matching colorants; and (e) calculating the amounts of the one or more matching colorants.

14. The method of claim 1, further including modifying the concentration of the one or more colorants as part of the selecting step.

15. The method of claim 1, wherein the supplied colorants comprise subtractive primary colorants.

16. The method of claim 1, further comprising modifying one of the supplied colorants to make another colorant.

17. The method of claim 1, further comprising sensing ink supply characteristics and controlling the colorant mixing station in response to the sensed characteristics.

18. The method of claim 1, further comprising:

regulating the supply of colorant to the colorant mixing station chamber.

19. The method of claim 18, wherein the regulation step comprises:

maintaining the level of the colorant in the colorant mixing station between predetermined upper and lower levels;

maintaining the concentration of colorant in the colorant mixing station within predetermined limits; and maintaining shifts in colorant color within predetermined limits.

20. The method of claim 19, wherein the shifts in colorant color include shifts in chromaticity and shifts in lightness.

21. The method of claim 18, wherein regulating the colorant supply comprises empirically determining the amount of each colorant to add to the colorant mixing station.

22. The method of claim 18, wherein the colorant is a liquid electrophoretic toner and empirically determining the amount of each colorant comprises using a lookup table to provide at least one of the following:

a listing of component colorants to use;

a volume of each component color concentrate to add to the colorant mixing station when the chamber is to be filled with a new colorant;

a volume of carrier fluid to add when the colorant mixing station is to be filled with a new colorant;

a volume of concentrate of a charge director to be added when a liquid toner colorant is used when the colorant mixing station is to be filled with a new mixed colorant;

a volume of each color concentrate to add to the colorant mixing station when the overall optical density of the colorant supply drops below a predetermined lower level;

color characteristics of a target color; and color characteristics of each supplied colorant.

23. The method of claim 21, wherein regulating of colorant supply comprises replenishing each supplied colorant in accordance with the empirical determination of each colorant amount.

24. The method of claim 1, further comprising removing the colorant mixture and saving it for later re-use.

25. The method of claim 1, further comprising providing a waste container; and removing the colorant mixture from the mixing chamber and placing the removed colorant mixture in the waste container.

26. The method of claim 25, further comprising:

emptying at least one colorant supply chamber and refilling each emptied colorant supply chamber with a cleaning fluid.

27. The method of claim 26, further comprising cleaning at least one of the at least one colorant supply chamber and the colorant mixing station with the cleaning fluid.

28. The method of claim 27, further comprising emptying the cleaning fluid into the waste chamber after cleaning the at least one of the at least one colorant supply chamber and the colorant mixing station.

29. A system of color matching using colorants supplied to a print engine having a colorant mixing station and at least one colorant supply chamber, comprising:

a controller to list the colorants needed to match the target colors;

a controller to determine the amounts of each colorant needed to make matches;

a controller to determine a schedule of target colors to be matched;

a controller to select colorants to match a first scheduled target color;

a mechanism to mix the selected colorants and supplying the mixture to the print engine;

an analyzer to determine color characteristics of a target colored medium to be matched using colorants supplied to the print engine;

a converter to convert the determined color characteristics of the target colored medium to color characteristics of a matching colored medium created by the print engine using the supplied colorants;

a generator to use the converted color characteristics of the matching colored medium to generate commands to the colorant mixing station;

a controller to respond to the colorant mixing station commands by introducing selected amounts of each selected colorant to create a matching colored medium;

a mixer to mix the selected one or more supplied colorants to form a matching colorant mixture;

a supplier to supply the color matching mixture of the one or more supplied colorants to the print engine;

a mechanism to remove at least one of the colorants in the colorant mixing station and replace it with another colorant.

30. The system of claim 29, further comprising:

a controller to repeat the colorant replacing step.

31. The system of claim 29, wherein the target colored medium is at least one colorant.

32. The system of claim 29, wherein the target colored medium is a medium on which the one or more selected colorants are printed by the print engine.

33. The system of claim 29, wherein:

the determination of the color characteristics includes specification of those characteristics in terms of CELAB L*a*b* coordinates.

34. The system of claim 29, wherein the selection of one or more matching colorants includes using a lookup table in which each matching colored medium is associated with a corresponding set of commands to the ink mixing station.

35. The system of claim 29, wherein the selection of one or more matching colorants includes using a lookup table in which each matching colored medium is associated with colored medium characteristics determined using measured color characteristics of the colorant supply.

36. The system of claim 29, wherein the selection of one or more matching colorants includes using a lookup table in which each matching colored medium is associated with colored medium characteristics determined using measured characteristics of the printed colored medium.

37. The system of claim 29, wherein the selection of one or more matching colorants includes using interpolation from a lookup table which contains fewer than the total number of colors reproducible by the one or more matching colorants.

38. The system of claim 29, wherein the selection of one or more matching colorants includes a combination of two or more of (a) using a lookup table in which each matching colored medium is associated with a corresponding set of commands to the ink mixing station; (b) using a lookup table in which each matching colored medium is associated with colored medium characteristics determined using measured color characteristics of the colorant supply; (c) using a lookup table in which each matching colored medium is associated with colored medium characteristics determined using measured characteristics of the printed colored medium; (d) using interpolation from a lookup table which contains fewer than the total number of colors reproducible by the one or more matching colorants; and (e) calculating the amounts of the one or more matching colorants.

39. The system of claim 29, further including a modifier to modify the concentration of the one or more colorants as part of the colorant selection.

40. The system of claim 29, wherein the supplied colorants comprise subtractive primary colorants.

41. The system of claim 29, further comprising a modifier to modify one of the supplied colorants to make another colorant.

42. The system of claim 29, wherein the mixing station includes pumps and valves, and further comprising a controller to operate the pumps and valves.

43. The system of claim 29, further comprising one or more detectors to sense ink supply characteristics and a controller to control the mixing station in response to the sensed characteristics.

44. The system of claim 29, wherein the mixing station has a notification device and further comprising a controller to actuate the notification device when one or more colorant supplies fall below a predetermined value.

45. The system of claim 29, wherein the number of color components is greater than the number of component colors supplied and further comprising a controller to actuate the notification device when additional component colors are needed.

46. The system of claim 29, wherein the determination of the color characteristics includes specification of the reflection spectrum of the color on the substrate.

47. The system of claim 29, further comprising:

a regulator to regulate the supply of colorant to the colorant supply chamber.

48. The system of claim 47, wherein the regulator maintains the level of the colorant in the colorant supply chamber between predetermined upper and lower levels;

maintains the concentration of colorant in the ink supply chamber within predetermined limits; and maintains shifts in colorant color within predetermined limits.

49. The system of claim 48, wherein the shifts in colorant color include shifts in chromaticity and shifts in lightness.

50. The system of claim 47, wherein the colorant regulator empirically determines the amount of each colorant to add to the colorant supply chamber.

51. The system of claim 47, wherein the empirical determination of the amount of each colorant comprises using a lookup table to provide at least one of the following:

a listing of component colorants to use;

a volume of each component color concentrate to add to the colorant supply chamber when the chamber is to be filled with a new colorant;

a volume of carrier fluid to add when the chamber is to be filled with a new colorant;

a volume of concentrate of a charge director to be added when a liquid toner colorant is used when the chamber is to be filled with a new mixed colorant;

a volume of each color concentrate to add to the chamber when the overall optical density of the colorant supply drops below a predetermined lower level;

color characteristics of a target color; and color characteristics of each supplied colorant.

52. The system of claim 47, wherein the colorant regulator replenishes each supplied colorant in accordance with the empirical determination of each colorant amount.

53. The system of claim 29, further comprising:

a controller to remove the colorant mixture and save it for later re-use.

54. The system of claim 29, further comprising:

a waste container to removing the colorant mixture from the mixing chamber and place it in the waste container.

55. The system of claim 29, further comprising:

an emptying device to empty the at least one colorant supply chamber and refilling the chamber with a cleaning fluid.

56. The system of claim 55, further comprising:

a cleaner to clean at least one colorant supply chamber and mixing station with the cleaning fluid.

57. The system of claim 55, further comprising:

an emptying device to empty the cleaning fluid into the waste chamber after cleaning the colorant supply chamber and mixing station.

58. The method of claim 29, wherein the print engine prints a color match for the first target color.

59. The method of claim 29, further comprising a controller to repeat the previous steps for the next scheduled target color.

60. The method of claim 29, further comprising a controller to determine if a colorant is to be replaced by another colorant to match at least one of the target colors.

61. A method of color matching using colorants supplied to a print engine having a colorant mixing station and at least one colorant supply chamber, comprising:

listing a plurality of target colors to be matched;

determining color characteristics of a target colored medium to be matched by colorants supplied to the print engine;

converting the determined color characteristics of the target colored medium to color characteristics of a matching colored medium using the supplied colorants;

listing the colorants needed to match the target colors;

determining the amounts of each colorant needed to make each target color;

scheduling an order of target colors to be matched;

selecting colorants to match a first scheduled target color;

mixing the selected colorants; and controllably integrating the previous steps to supply the mixture to the print engine.

62. A method of color matching using colorants supplied to a print engine having a colorant mixing station and at least one colorant supply chamber, comprising:

listing a plurality of target colors to be matched;

converting the determined color characteristics of the target colored medium to color characteristics of a matching colored medium using the supplied colorants;

listing the colorants needed to match the target colors;

determining the amounts of each colorant needed to make each target color;

scheduling an order of target colors to be matched;

selecting colorants to match a first scheduled target color;

mixing the selected colorants; and controllably integrating the previous steps to supply the mixture to the print engine.

63. A method of color matching using colorants supplied to a print engine having a colorant mixing station and at least one colorant supply chamber, comprising:

listing a plurality of target colors to be matched;

listing the colorants needed to match the target colors;

determining the amounts of each colorant needed to make each target color;

determining a schedule of target colors to be matched, selecting colorants to match each scheduled target color;

mixing the selected colorants; and controllably integrating the previous steps to supply the mixture to the print engine.

64. The method of claim 31, wherein determining the color characteristics includes specifying the reflection spectrum of the target color on the target substrate.

65. The method of claim 32, wherein determining the color characteristics includes specifying the reflection spectrum of the target color on the target substrate.

66. The method of claim 1, wherein the scheduling an order of target colors to be matched is based upon the amount of each colorant needed to match all target colors.

67. The method of claim 1, wherein the scheduling an order of target colors to be matched is based upon a ranking of which colorants are used in target color matches from use in the mist target color matches to use in the fewest target color matches.

68. The method of claim 1, wherein the scheduling an order of target colors to be matched is based upon a ranking of the number of colorants needed for each target color match from the largest number of colorants to the fewest number of colorants.

69. The method of claim 1, wherein the scheduling an order of target colors to be matched is based upon the fewest number of changeovers of colorants needed to match all of the target colors.

* * * * *